US008373079B2

(12) United States Patent
Walkington

(10) Patent No.: US 8,373,079 B2
(45) Date of Patent: Feb. 12, 2013

(54) WOVEN MANUALLY OPERABLE INPUT DEVICE

(75) Inventor: Stuart Mark Walkington, St. Albans (GB)

(73) Assignee: Peratech Limited, Brompton on Swale, Richmond (GB)

( * ) Notice: Subject to any disclaimer, the term of this patent is extended or adjusted under 35 U.S.C. 154(b) by 637 days.

(21) Appl. No.: 12/513,037

(22) PCT Filed: Nov. 7, 2007

(86) PCT No.: PCT/GB2007/004255

§ 371 (c)(1), (2), (4) Date: Jan. 26, 2010

(87) PCT Pub. No.: WO2008/056145

PCT Pub. Date: May 15, 2008

(65) Prior Publication Data

US 2010/0126840 A1 May 27, 2010

(30) Foreign Application Priority Data

Nov. 8, 2006 (GB) ..... 0622204.6

(51) Int. Cl.
*H01H 1/10* (2006.01)

(52) U.S. Cl. ..... 200/512; 200/506

(58) Field of Classification Search ..... 200/506, 200/512; 339/47; 338/47
See application file for complete search history.

(56) References Cited

U.S. PATENT DOCUMENTS

| | | | |
|---|---|---|---|
| 6,210,771 | B1 | 4/2001 | Post et al. |
| 2003/0211797 | A1 | 11/2003 | Hill et al. |

FOREIGN PATENT DOCUMENTS

| | | | |
|---|---|---|---|
| WO | 03052541 | A | 6/2003 |
| WO | 2005073685 | A | 8/2005 |
| WO | 2006030230 | A | 3/2006 |

*Primary Examiner* — Briggitte R Hammond
(74) *Attorney, Agent, or Firm* — Arthur Jacob

(57) ABSTRACT

A manually operable sensor for providing control signals to an electronic device. A fabric has a length substantially longer than its width with insulating yarns and electrically conductive yarns included therein, such that the conductive yarns define three conductive tracks running the length of the fabric. The conductive tracks are configured to interface with an electronic device at a first end and, at a second end, an active region of the fabric forms part of a sensor assembly that is receptive to a manually applied pressure. The sensor comprises first and second conductive regions to which a first and a second conductive track are connected respectively, to apply an electric potential to each conductive region. A conductive path is formed between a connected conductive track and the third conductive track of said active region when manual pressure is applied to one of the conductive regions.

14 Claims, 7 Drawing Sheets

WOVEN MANUALLY OPERABLE INPUT DEVICE

BACKGROUND OF THE INVENTION

The present invention relates to a manually operable sensor for providing signals to an electronic device.

A manually operable position sensor is disclosed in U.S. Pat. No. 6,452,479, assigned to the present applicant. It is known for sensors of this type to communicate with electronic devices. In order to provide electrical communication between a sensor assembly and the electronic device, it is necessary to define tracks for electrical conduction. In known assemblies, these tracks are provided using electrically conductive tape surrounded by an insulating material. The tape itself is relatively expensive and, furthermore, costs are involved in terms of creating the assembly itself.

BRIEF SUMMARY OF THE INVENTION

According to an aspect of the present invention, there is provided a manually operable sensor for providing control signals to an electronic device, comprising: fabric having a length substantially longer than its width with insulating yarns and electrically conductive yarns included therein, such that said conductive yarns define first, second and third conductive tracks running the length of said fabric; said conductive tracks are configured to interface with an electronic device; and, at a second end an active region of the fabric forms part of a sensor assembly that is receptive to a manually applied pressure; wherein said sensor assembly comprises: a first conductive region and a separate second conductive region; said first conductive track is connected to said first conductive region, to apply a first electric potential, said second conductive track is connected to said second conductive region, to apply a second electric potential, a conductive path is formed between said first conductive track and said third conductive track of said active region when manual pressure is applied to said first conductive region, and a conductive path is formed between said second conductive track and said third conductive track of said active region when manual pressure is applied to said second conductive region.

It should therefore be appreciated that the invention provides for relatively inexpensive transmission tracks. Furthermore, these tracks are included within the sensor itself thereby further facilitating construction. A sensor of this type is particularly suitable for switch control, as used for the control of electronic devices such as mobile phones and audio players.

The particular nature of the fabric may vary but in a preferred embodiment the fabric is produced by a weaving process in which the weft yarns are woven between warp yarns and the conducting yarns are included as part of the warp yarns.

According to a second aspect of the present invention, there is provided a method of constructing a manually operable sensor for providing control signals to an electronic device, comprising the steps of: weaving a fabric with electrically conducting warp yarns that define three conductive tracks that run the length of the fabric; connecting said conductive tracks at a first end to a connector for interfacing with an electronic device; and, at a second end forming a sensor assembly that is receptive to manually applied pressure over an active region of the fabric, the sensor assembly comprising a first conductive region and a separate second conductive region; connecting a first conductive track to said first conductive region, and connecting a second conductive track to said second conductive region.

BRIEF DESCRIPTION OF THE SEVERAL VIEWS OF THE DRAWINGS

The invention will now be described by way of example only, with reference to the accompanying drawings, of which.

WRITTEN DESCRIPTION OF THE BEST MODE FOR CARRYING OUT THE INVENTION

FIG. 1

Figure 1:
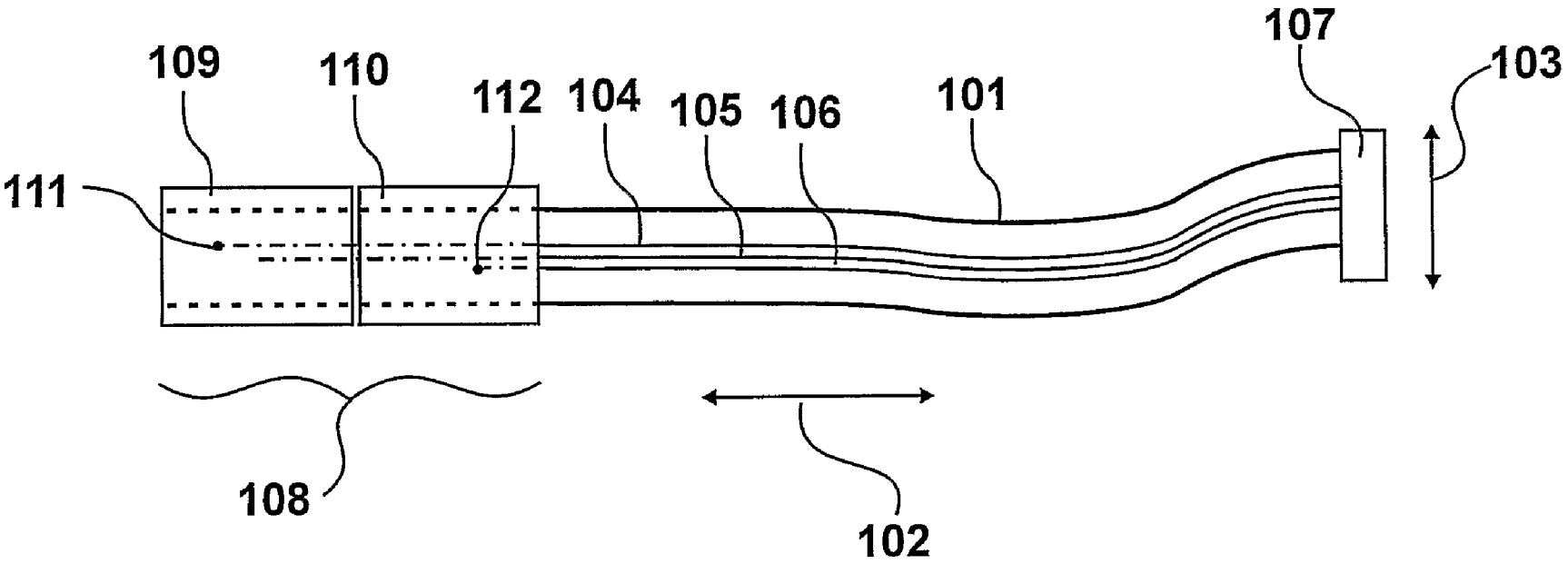
FIG. 1 illustrates an embodiment of a manually operable sensor.

An embodiment of a manually operable sensor is illustrated in FIG. 1. A fabric strip or ribbon 101 has a length, illustrated by arrows 102, that is substantially longer than its width, illustrated by arrow 103. For example, the length of ribbon 101 may be typically seven hundred and fifty millimetres (750 mm) with a typical width of twenty-five millimetres (25 mm). The fabric has electrically insulating yarns and electrically conducting yarns included therein. The conducting yarns define three conductive tracks 104, 105 and 106 that are connected to an electrical connector 107. The electrical connector is provided to facilitate the interfacing of the sensor with an electronic device. At its opposite end, an active region 108 of the fabric forms part of a sensor assembly that is receptive to a manually applied pressure.

In a preferred sensor, the fabric is produced by a weaving process in which weft yarns are woven between warp yarns and the conducting yarns, that form tracks 104, 105 and 106, are included as part of the warp yarns. Thus, as the fabric is woven, it is produced in the direction indicated by arrow 102.

In a preferred embodiment, the conductive yarns are silver coated nylon and each conductive track 104 to 106 may have between five (5) and ten (10) conducting yarns, with seven (7) conducting yarns being present in a preferred embodiment. Multifilament conductive yarns or threads may be used in the construction of the sensor.

In a preferred embodiment, the spacing between the conductive tracks (the insulating portions) is such that it is greater than the width of the conducting tracks themselves. Preferably, the spacing is made consistent with readily available circuit connectors, such as circuit connector 107 that, typically, facilitates a spacing of two point five millimetres (2.5 mm). Thus, if alternate connections are selected, a spacing of five millimetres (5 mm) is achievable, as is preferred in the present embodiment.

In a preferred embodiment, active region 108 forms part of a sensor assembly providing discrete switches, in which the application of manual pressure is identified through detection of an electrical connection between two conductive tracks. The sensor assembly comprises a first conductive region 109 and a separate second conductive region 110. A first conductive track 104 may apply plus volts to a position 111 of the first conductive region 109. Similarly, second conductive track 105 may apply plus volts to a position 112 of the second conductive region 110. At a position where pressure is applied to the first conductive region, causing a mechanical interaction, a voltage is applied to conductive track 105, and at a position where pressure is applied to the second conductive region a voltage is also applied to conductive track 105 in response. Thus, the first and second conductive regions, in combination with the active region of the fabric, provide two discrete switches. The position of conductive regions may be emphasised by the provision of masking.

A function may be associated with each of the first and second conductive regions, such that by determining which of the first and second discrete switches has been manipulated, it is possible to determine the actual function that has been selected.

FIG. 2

Figure 2:
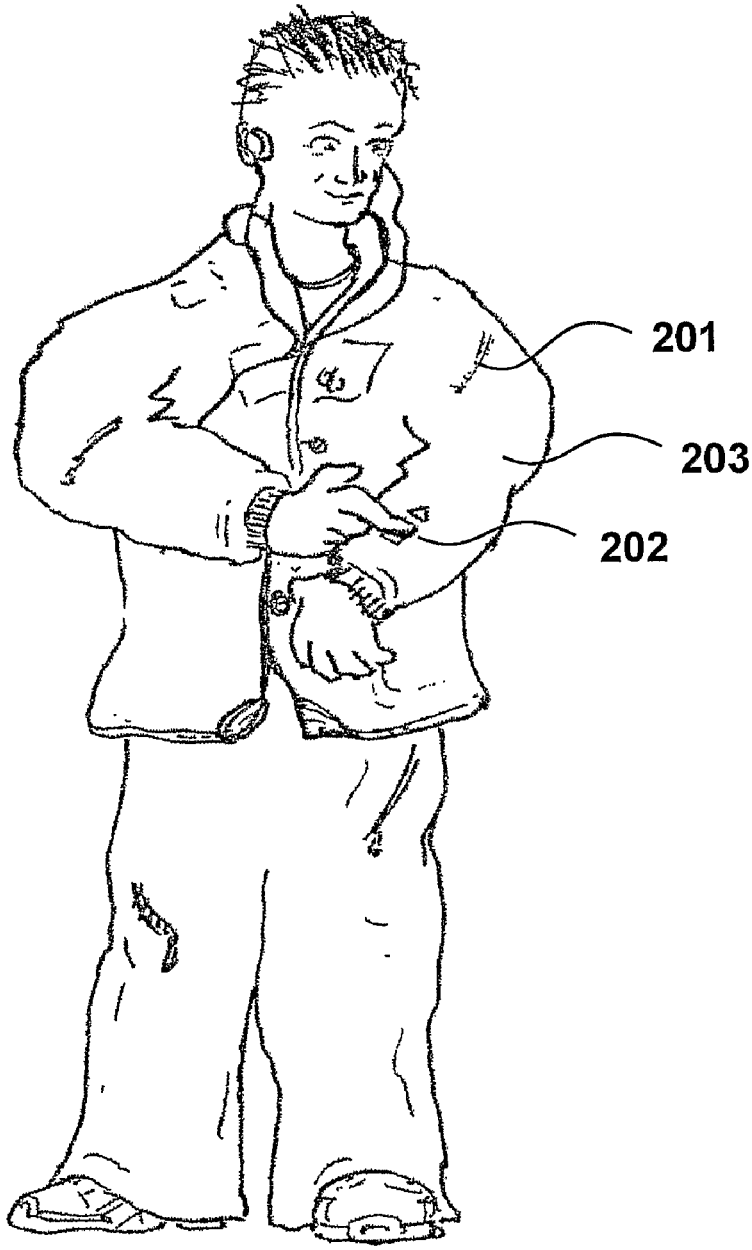
FIG. 2 shows an example of an application for the sensor identified in FIG. 1.

An example of an application for the sensor is shown in FIG. 2. In this example, the sensor is included in a jacket 201. A manually operable data input device 202, operating in accordance with the sensor technology of the preferred embodiment, is fabricated into an arm 203 of the jacket. The data input device is configured to receive input data from a user which, for example, may be used to control a warming panel within the jacket. Such a warming panel may include a battery-powered heat pad that contains textile wires and has adjustable temperature control. Thus, a control may be provided for on/off operation of the warming panel and another may be provided for adjusting the operating temperature of the warming panel.

Alternatively, the data input device may include commands for controlling a mobile device such as a radio device, a mobile telephone or an audio player, such as an MP3 player.

FIG. 3

Figure 3:
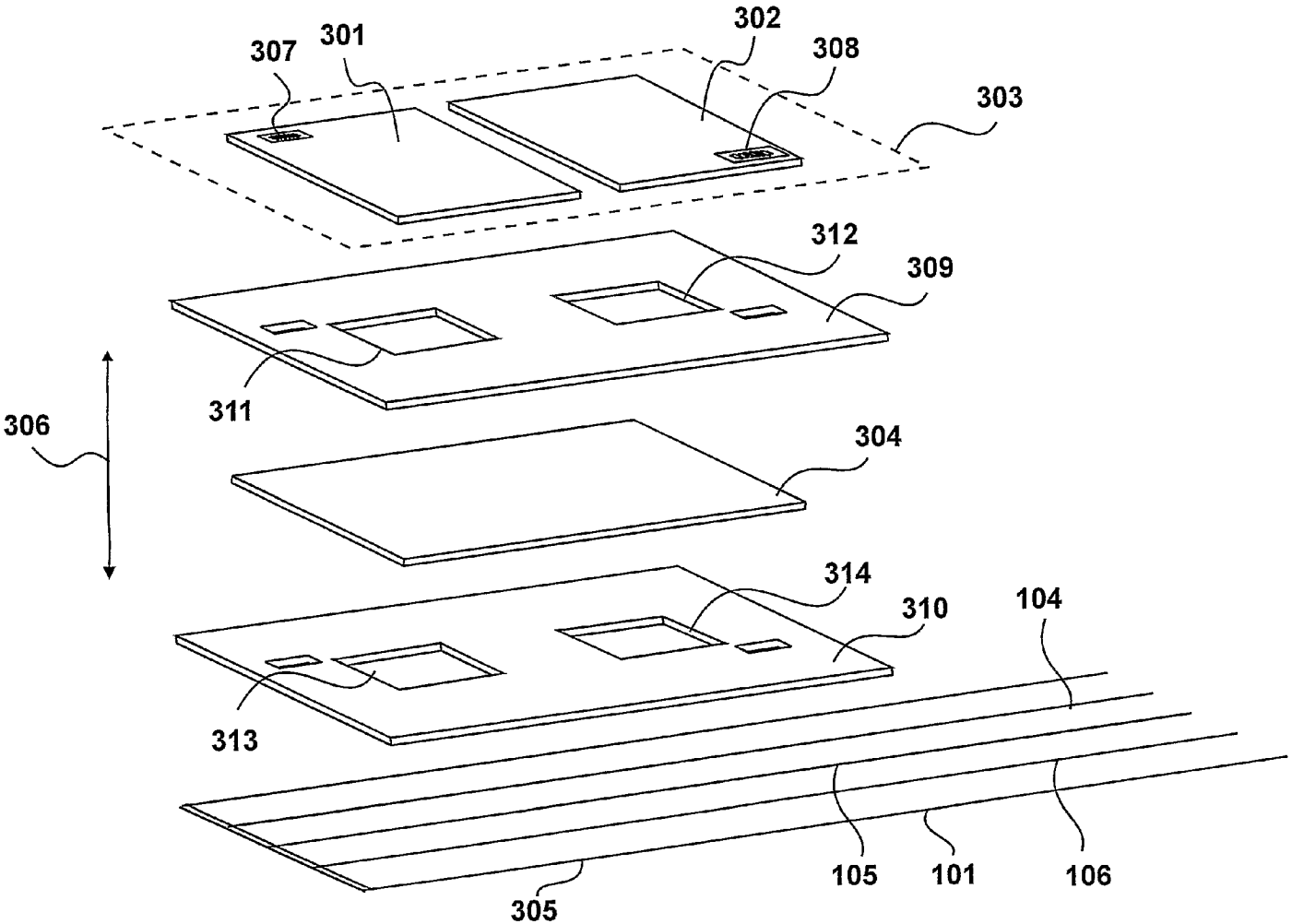
FIG. 3 shows a sensor construction.

An example of a sensor construction is illustrated in FIG. 3. The sensor includes a first conductive region 301 and a separate second conductive region 302. In the shown example, the first and second conductive regions are independent components that are oriented in the same plane 303. In an alternative arrangement, both conductive regions are included in a conductive fabric layer in which they are insulated from one another. In the sensor assembly, a separation layer 304 is placed between the first and second conductive regions 301, 302 and an active region 305 of fabric 101.

In FIG. 3, an exploded view is presented but it will be appreciated that, in use, the individual layers are placed in contact. In addition, electrical conduction in the vertical direction, illustrated by arrow 306, is provided by stitching through the layers using conductive threads. Thus, by the provision of stitching, conductive track 104 is electrically connected to a corner 307 of conductive region 301. Similarly, conductive track 106 is electrically connected to a corner 308 of the second conductive region 302. Preferably, the conductive regions 301,302 are constructed from carbonised nylon.

Without pressure being applied, separation layer 304 prevents the conductive regions 301, 302 from being placed into electrical contact with the central third conductive track 105. However, when pressure is applied, separation layer 304 is compressed and as such electrical connection takes place at the position of the mechanical interaction, that is, where the pressure is applied.

To facilitate the detection of a mechanical interaction with a conductive region, masking means are provided. In the preferred embodiment, the masking means includes a first mask 309 and a second mask 310. The first mask 309 is located above the separation layer 304 and the second mask 310 is located below the separation layer. First mask 309 defines a first window 311 vertically aligned within first conductive region 301 and a second window 312 vertically aligned within second conductive region 302. Similarly, second mask 310 defines a third window 313 vertically aligned with first window 311 and a fourth window 314 vertically aligned with second window 312.

FIG. 4

Figure 4:
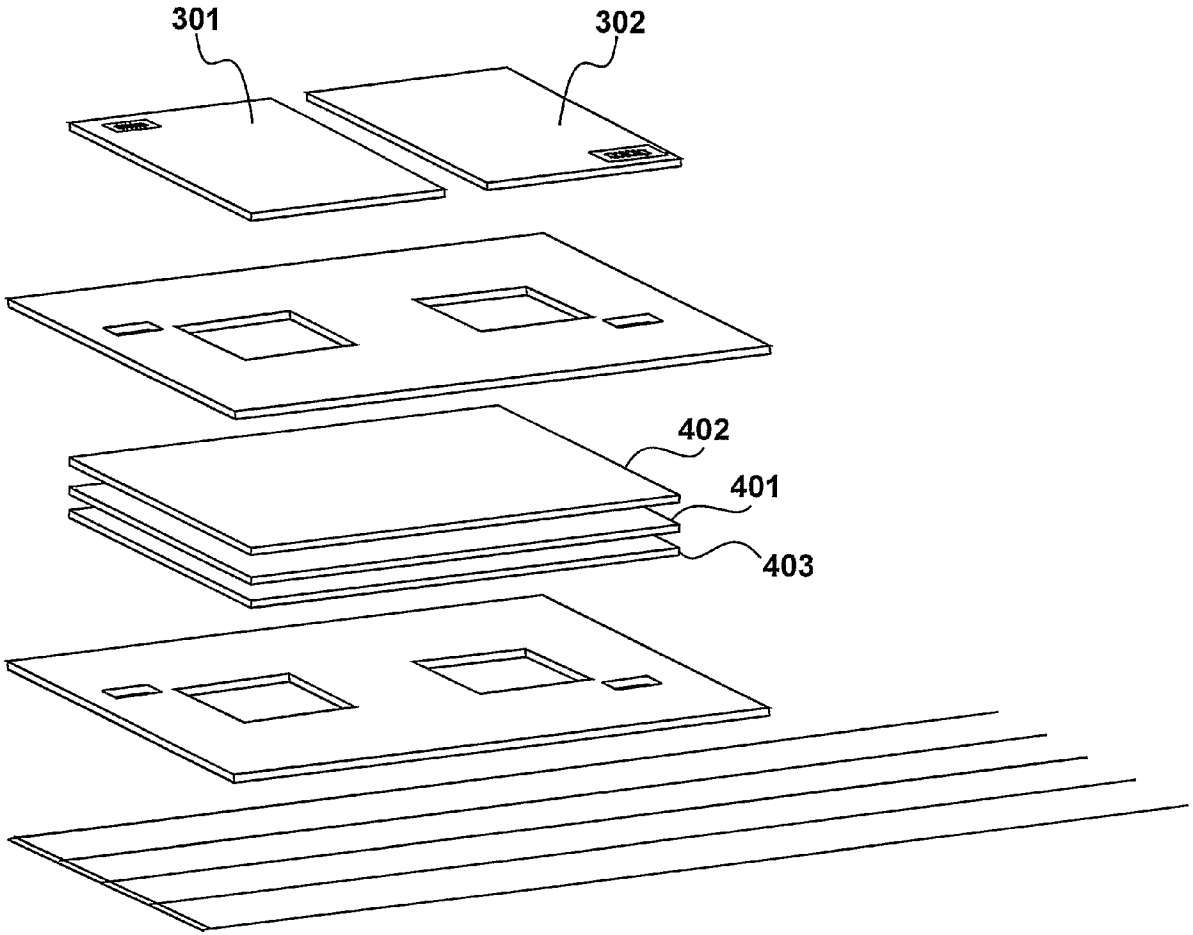
FIG. 4 shows an enhancement to the sensor construction of FIG. 3.

An enhanced embodiment is illustrated in FIG. 4 that deploys additional component layers similar to those disclosed in the aforesaid US patent assigned to the present applicant. In this preferred embodiment, the single separation layer 304 is replaced with three separate layers, a central layer 401 being conductive, while an upper layer 402 is an insulating separator layer and a lower layer 403 is also an insulating separator layer. In this configuration, conduction occurs when manual pressure is applied to a conductive region 301, 302. However, the provision of the additional layers prevents accidental triggering when, for example, the material is bent or folded. In addition, it will be appreciated that other technical solutions may be provided to give the functionality of the separation layer.

FIG. 5

Figure 5:
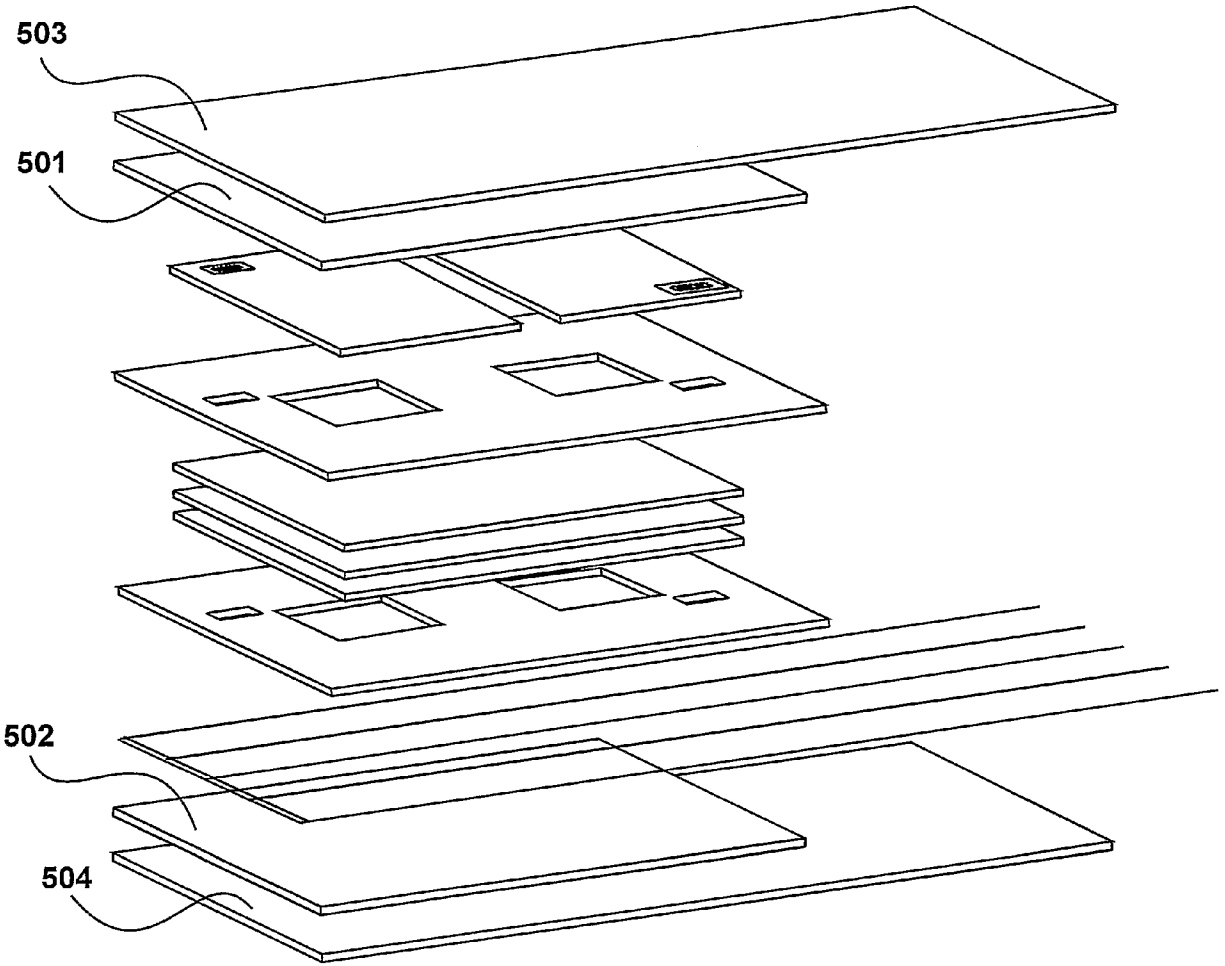
FIG. 5 illustrates additional sensor construction elements.

As illustrated in FIG. 5, an upper cover 501 is preferably provided, along with a lower cover 502, to protect the operation of the sensor in the active region. Furthermore, an upper waterproof cover 503 and a lower waterproof cover 504 are provided that run the length of the sensor from the active region to the electrical connector.

FIG. 6

Figure 6:
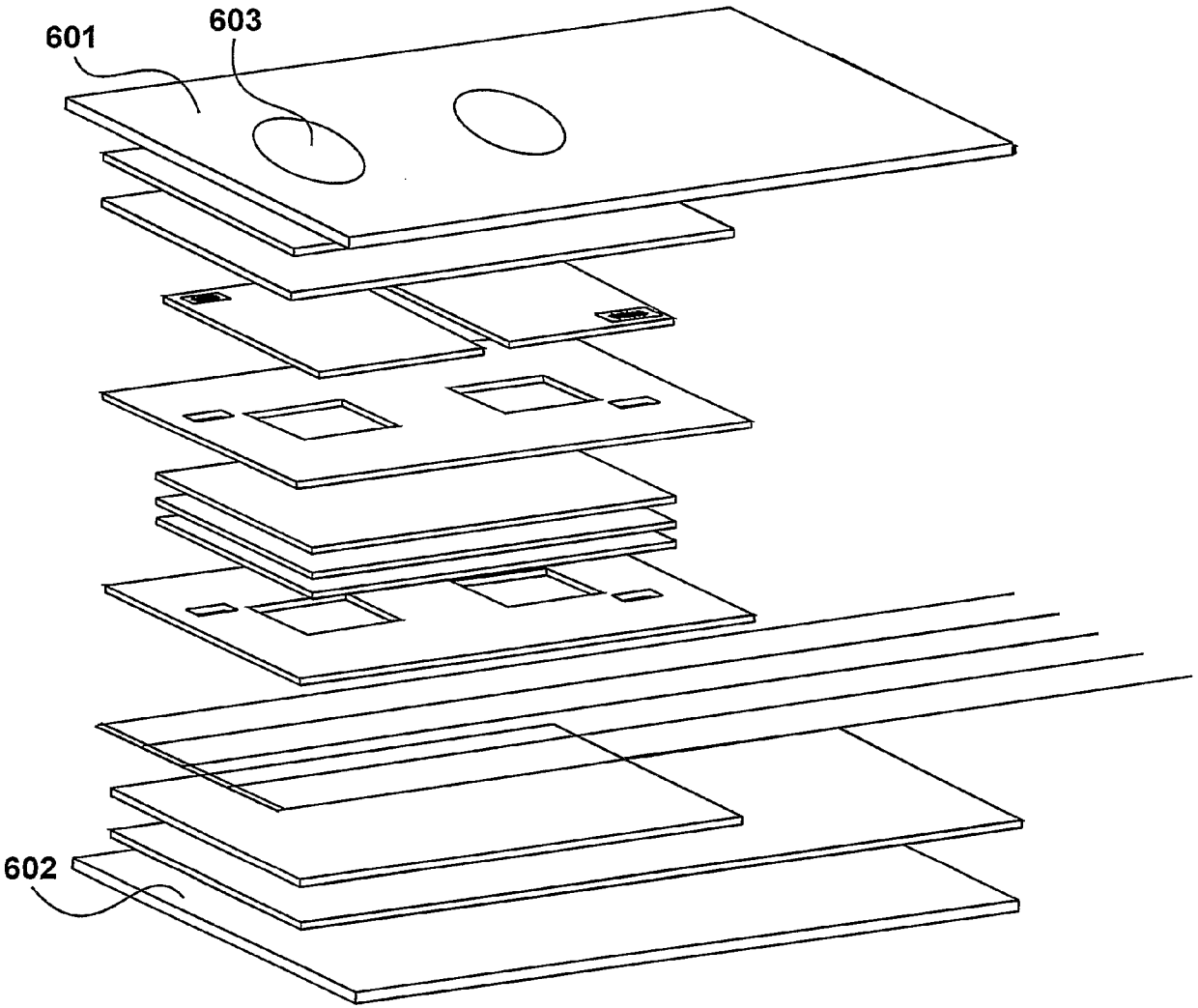
FIG. 6 illustrates further additional sensor construction elements.

As illustrated in FIG. 6, further material is provided at 601 and 602 to facilitate the sewing of the sensor into a bag, jacket (as illustrated in FIG. 2) or other material environment so as to ensure robust operation. In addition, the upper cover 601 may include graphical representations, illustrated at 603, which relate to particular device functions. Thus, in the example shown in FIG. 2, in which the device is used to control a warming panel, these graphical representations relate to particular operations of a heat pad, such as on/off and operating temperature control.

FIG. 7

Figure 7:
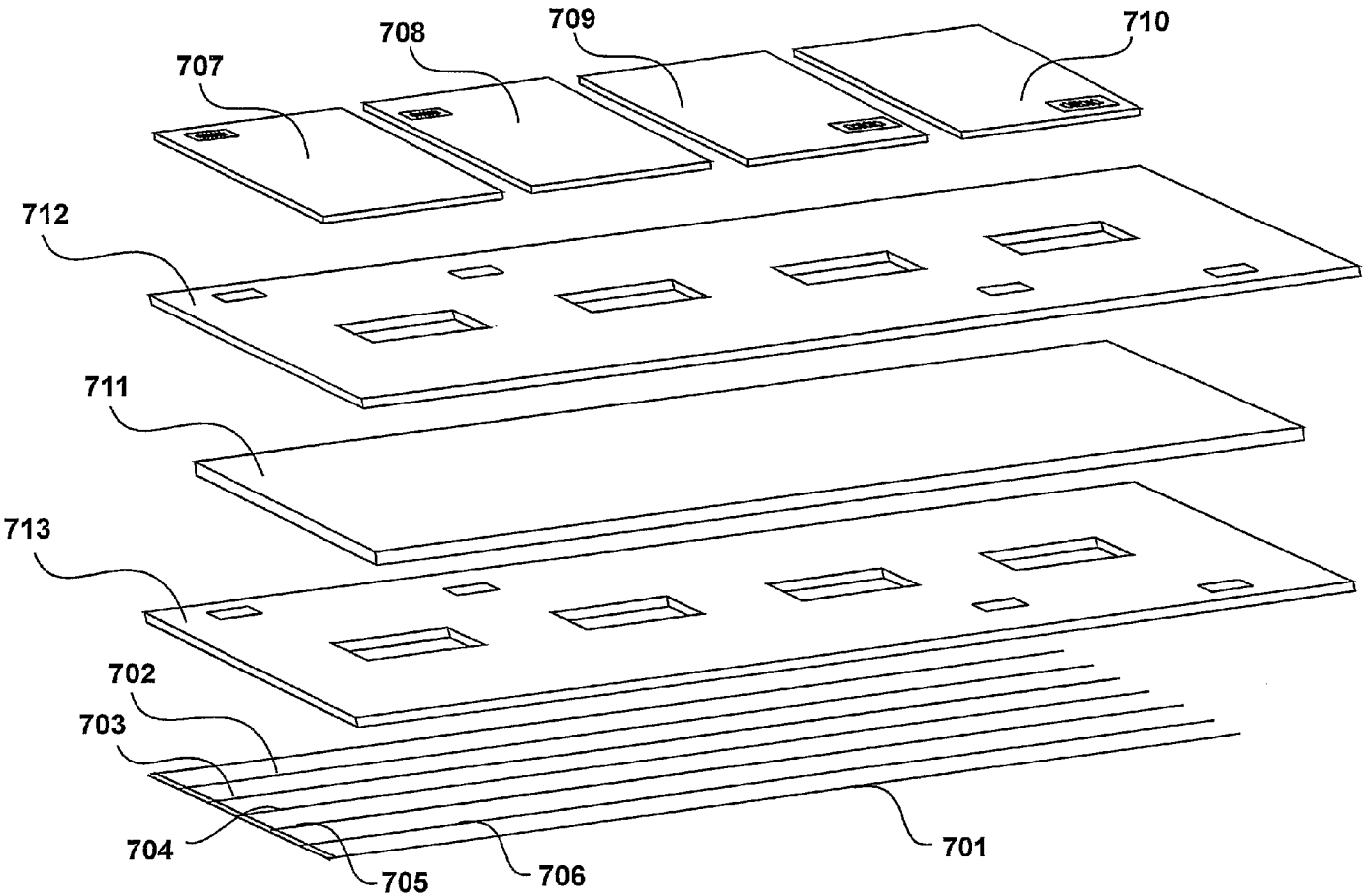
FIG. 7 illustrates a further sensor arrangement.

A further sensor arrangement is illustrated in FIG. 7. A fabric strip or ribbon 701 defines five conductive tracks 702, 703, 704, 705 and 706. The sensor assembly comprises four separate conductive regions 707, 708, 709 and 710. As shown, the sensor assembly further comprises a separation layer 711, a first mask layer 712 above the separation layer 711 and a second mask layer 713 below the separation layer 711.

Within the sensor assembly, conductive tracks 702, 703, 705 and 706 are respectively electrically connected to conductive regions 707, 708, 709 and 710 by conductive stitching, with central conductive track 704 remaining as the common track to which electrical connection is made during a mechanical interaction. The sensor hence provides four (4) discrete digital switches, being arranged such that a conductive path is established between conductive tracks 702 and 704, 703 and 704, 705 and 704 or 706 and 704 depending upon which conductive region manual pressure is applied. Thus, it can be understood that to provide a number X of switches, the number X+1 conductive tracks are required.

In summary, it will be appreciated that the switch sensor may be constructed by firstly weaving a fabric with electrically conducting warp yarns that define three conductive tracks that run the length of the fabric. An electrical connector is connected to the conductive tracks at a first end to facilitate the interfacing of the sensor with an electronic device. Then, at a second end, a sensor assembly is formed that is receptive to manually applied pressure over an active region of the fabric.

The invention claimed is:

1. A manually operable sensor for providing control signals to an electronic device, comprising:

a fabric having a length, a width, a first end and a second end, the length being substantially longer than the width, with insulating yarns and electrically conductive yarns included therein, such that said conductive yarns define a first conductive track, a second conductive track, and a third conductive track, said first, second and third conductive tracks each having a track width, and a track length running the length of said fabric, and said insulating yams providing the fabric with an insulating portion between adjacent conductive tracks;

said conductive tracks being configured for interfacing with an electronic device placed at the first end of the fabric, and for extending into an active region of the fabric at the second end of the fabric; and a sensor assembly located at the second end of the fabric, juxtaposed with the active region, the sensor assembly comprising:

a first conductive region, and a second conductive region separated from the first conductive region;

said first conductive track being connected to said first conductive region for applying a first electric potential to the first conductive region;

said second conductive track being connected to said second conductive region for applying a second electric potential to the second conductive region;

said first and second conductive regions each being juxtaposed with the third conductive track and being receptive to manual pressure such that a conductive path will be established between said first conductive track and said third conductive track, at said active region, in response to manual pressure applied to said first conductive region, and a conductive path will be established between said second conductive track and said third conductive track, at said active region, in response to manual pressure applied to said second conductive region; and wherein the insulating portion of the fabric between adjacent conductive tracks is wider than the track width of the adjacent conductive tracks.

2. A sensor according to claim 1, wherein the conductive yarns are silver coated nylon.

3. A sensor according to claim 1, wherein the spacing between conductive tracks is two point five millimeters.

4. A sensor according to claim 1, wherein said sensor is configured to be attached to a garment or a bag.

5. A sensor according to claim 1, wherein said fabric is produced by a weaving process in which weft yarns are woven between warp yarns and the conductive yarns are included as part of the warp yarns.

6. A sensor according to claim 5, wherein at least one of said conductive tracks is created from a plurality of conductive yarns.

7. A sensor according to claim 6, wherein each conductive track is created from between five and ten conductive yarns.

8. A manually operable sensor for providing control signals to an electronic device, comprising:

a fabric having a length, a width, a first end and a second end, the length being substantially longer than the width, with insulating yarns and electrically conductive yarns included therein, such that said conductive yarns define a first conductive track, a second conductive track, and a third conductive track, said first, second and third conductive tracks each having a track width, and a track length running the length of said fabric, and said insulating yarns providing the fabric with an insulating portion between adjacent conductive tracks;

said conductive tracks being configured for interfacing with an electronic device placed at the first end of the fabric, and for extending into an active region of the fabric at the second end of the fabric: and a sensor assembly located at the second end of the fabric, juxtaposed with the active region, the sensor assembly comprising:

a first conductive region, and a second conductive region separated from the first conductive region;

said first conductive track being connected to said first conductive region for applying a first electric potential to the first conductive region;

said second conductive track being connected to said second conductive region for applying a second electric potential to the second conductive region;

said first and second conductive regions each being juxtaposed with the third conductive track and being receptive to manual pressure such that a conductive path will be established between said first conductive track and said third conductive track, at said active region, in response to manual pressure applied to said first conductive region, and a conductive path will be established between said second conductive track and said third conductive track, at said active region, in response to manual pressure applied to said second conductive region; and said first conductive region and said second conductive region are included in a conductive fabric layer, and a separation layer is disposed between said conductive fabric layer and said active region of said fabric.

9. A sensor according to claim 8 including masking means for defining active locations at positions on said active region.

10. A manually operable sensor for providing control signals to an electronic device, comprising:

a fabric having a length, a width, a first end and a second end, the length being substantially longer than the width, with insulating yarns and electrically conductive yarns included therein, such that said conductive yarns define a first conductive track, a second conductive track, and a third conductive track, said first, second and third conductive tracks each having a track width, and a track length running the length of said fabric, and said insulating yarns providing the fabric with an insulating portion between adjacent conductive tracks;

said conductive tracks being configured for interfacing with an electronic device placed at the first end of the fabric, and for extending into an active region of the fabric at the second end of the fabric; and a sensor assembly located at the second end of the fabric, juxtaposed with the active region, the sensor assembly comprising:

a first conductive region, and a second conductive region separated from the first conductive region;

said first conductive track being connected to said first conductive region for applying a first electric potential to the first conductive region;

said second conductive track being connected to said second conductive region for applying a second electric potential to the second conductive region;

said first and second conductive regions each being juxtaposed with the third conductive track and being receptive to manual pressure such that a conductive path will be established between said first conductive track and said third conductive track, at said active region, in response to manual pressure applied to said first conductive region, and a conductive path will be established between said second conductive track and said third conductive track, at said active region, in response to manual pressure applied to said second conductive region;

a separation layer between the active region of the fabric and the first and second conductive regions; and masking means for defining active locations at said active region, said masking means including a first mask and a second mask, said first mask being located above said separation layer and said second mask being located below said separation layer.

11. A sensor according to claim 10, including a cover sheet, wherein said cover sheet has graphical representations of device functions printed at respective positions of said active locations.

12. A sensor according to claim 8, wherein:

said separation layer includes a first insulating layer, a second conductive layer and a third insulating layer; and both of said first and third insulating layers allow conduction there through when manual pressure is applied but at least one will prevent conduction under conditions of bending.

13. A sensor according to claim 12, wherein at least one of said first conductive layer and said second conductive layer includes carbonised nylon.

14. A sensor according to claim 12, wherein both said first conductive layer and said second conductive layer includes carbonized nylon.

* * * * *